US006499590B1

(12) United States Patent
Godshaw et al.

(10) Patent No.: US 6,499,590 B1
(45) Date of Patent: Dec. 31, 2002

(54) CASE FOR NECK TIES

(75) Inventors: Donald E. Godshaw, Evanston, IL (US); Andrezj Redzisz, Skokie, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/952,531

(22) Filed: Sep. 14, 2001

(51) Int. Cl.[7] ..... B65D 85/18

(52) U.S. Cl. ..... 206/278; 206/293; 206/288; 206/283; 206/284

(58) Field of Search ..... 206/278, 525.1, 206/293, 288, 284, 283

(56) References Cited

U.S. PATENT DOCUMENTS

| | | | | |
|---|---|---|---|---|
| 862,154 A | * | 8/1907 | Greenawalt | 206/278 |
| 1,112,611 A | * | 10/1914 | Hauser | 206/278 |
| 6,237,761 B1 | * | 5/2001 | Godshaw et al. | 206/278 |

* cited by examiner

*Primary Examiner*—Stephen P. Garbe
*Assistant Examiner*—Tri M. Mai
(74) *Attorney, Agent, or Firm*—Banner & Witcoff, Ltd.

(57) ABSTRACT

A carrying case for neck ties comprises three panels which fold one over the other and include special loops to support the midpoint of the ties within the carrying case. The separate panels are connected by soft, living hinges. The carrying case is especially useful in smaller luggage cases of the type popular for airline carry on travel.

5 Claims, 2 Drawing Sheets

CASE FOR NECK TIES

BACKGROUND OF THE INVENTION

In a principal aspect the present invention relates to a carrying case for neck ties, and more particularly, to a carrying case for neck ties which enables the ties to be folded without unnecessary creasing in a compact manner enabling them to be stored in a relatively small item of luggage, such as an airline carry-on case.

Carrying cases for neckties have previously been available in combination with travel luggage. Typically, a carrying case for a necktie comprises an elongate panel with a fabric cover that has zipper access through the panel so that the tie may be placed with a single fold within the necktie case. With the advent of smaller and smaller sizes of luggage that may be carried onto airlines, there has developed a need for a tie case which will enable packing thereof within the smaller sizes of carry-on luggage. However, a problem that may result when attempting to fold a tie with multiple folds is the development of undesired creasing in the tie. Thus, there has developed the need for an improved neck tie carrying case which will provide protection for the tie yet enable folding of the tie with multiple folds without undesired creasing. Additionally, it is desired to have a neck tie case which enables use thereof in combination with smaller style luggage cases that are acceptable as carry on items for airline travel.

SUMMARY OF THE INVENTION

Briefly, the present invention comprises a carrying case for neck ties which includes three panels each connected one to the other by a flexible living hinge wherein tie support rings or ring members are attached to one end panel by a ribbon member in a manner which permits the placement of multiple ties on the inside surface of the carrier. Retention straps and folding retention rings are also provided to hold the ties in place. The three panels may then be folded, one over the other, for storage and transport of the ties. A buckle is provided to close the panels and maintain them in the folded condition. Hanging straps are provided to support the open case.

Thus, it is an object of the invention to provide an improved carrying case for neck ties which includes three panels made of generally semi-rigid material that are connected one to the other by means of very flexible hinge sections.

It is a further object of the invention to provide a necktie carrying case which may be folded with multiple ties therein in a manner which permits storage of the case in a protective fashion within smaller sizes of luggage.

Yet another object of the invention is to provide a neck tie carrying case which provides for folding of multiple panels in a manner which protects the ties yet, when the panels are arranged in an unfolded or planar condition, will permit easy access to the ties.

Another object of the invention is to provide a neck tie carrying case which is compact, easy to use, may be utilized to hold multiple ties, and which includes various means for hanging the carrying case with the ties in a folded condition or an unfolded condition.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
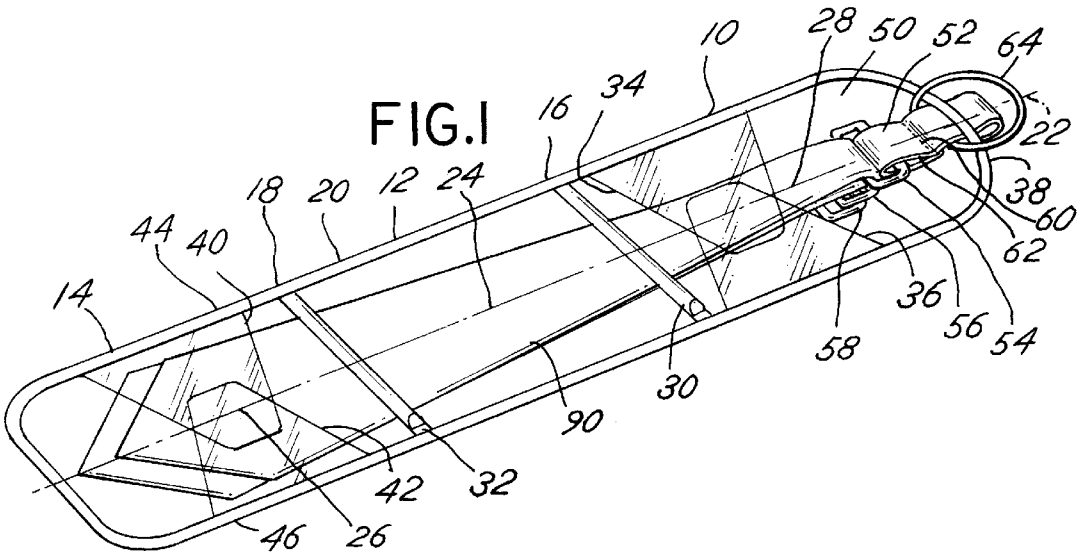
FIG. 1 is an isometric view of the neck tie carrying case of the invention wherein the case is in the unfolded condition with the inside of the case exposed.

Referring to the figures, the necktie carrying case of the invention is comprised of a first or top, semi-rigid panel 10, a connected middle or a second, semi-rigid panel 12 and a third, lower or bottom semi-rigid panel 14. The panels 10, 12 and 14 are connected seriatim by flexible living hinges. Thus, a living hinge 16 connects panels 10 and 12. A living hinge 18 connects the semi-rigid panels 12 and 14. Preferably, the panels, for example, 10, 12 and 14 may be formed by encapsulating or sewing semi-rigid, flat boards forming the panels 10, 12 and 14 within a fabric cover. The fabric cover thus serves as the living hinge 16, 18 and the semi-rigid panels 10, 12 and 14 will be formed by the enclosed semi-rigid boards, for example, a polypropylene or polyethylene sheet formed in an appropriate shape encapsulated within the fabric sleeve.

Edge binding attached as a circumferential rib 20 may thus be sewn onto opposed sheets of fabric material to enclose sheets of the semi-rigid material and thereby maintain all of these materials assembled in relation, one to the other. Padding may be included within the sleeve t formed by the fabric. Thus, a thin layer padding may be fitted over the boards which form the panels 10, 12 and 14.

Figure 3:
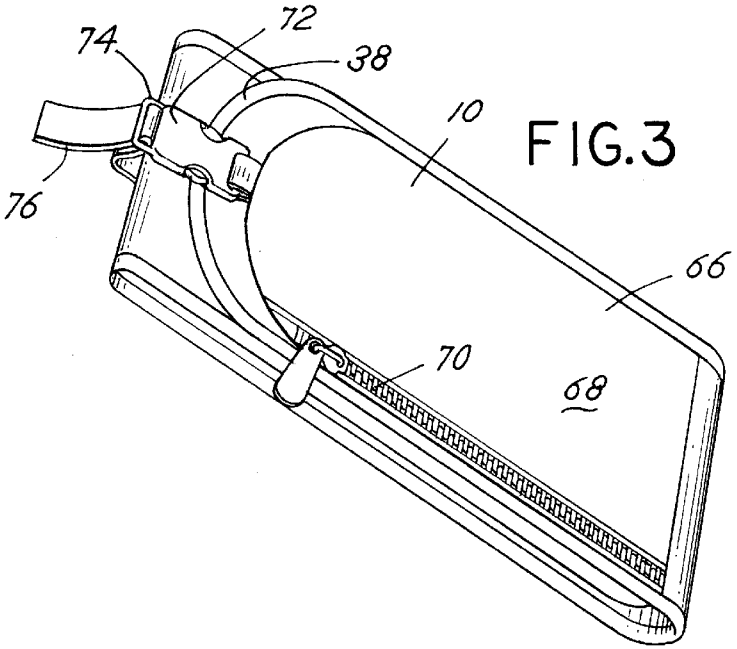
FIG. 3 is an isometric view of the carrying case of FIG. 1 wherein the semi-rigid panels comprising the case have been folded and buckled together in manner which protects the ties yet avoids creasing the ties.
Figure 4:
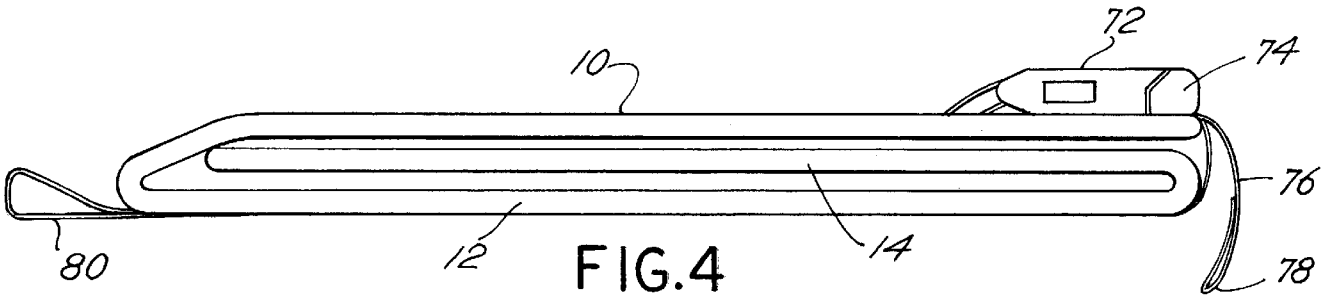
FIG. 4 is a side elevation of the folded carrying case of FIG. 3.

The panels 10, 12 and 14 define a longitudinal axis 22 having associated therewith a longitudinal dimension for each of the panels 10, 12 and 14. The middle panel 12 thus includes a longitudinal dimension between the hinge sections 16 and 18 along the axis 22, namely, a dimension 24. The lower panel or bottom panel 14 defines a longitudinal dimension 26, which in the preferred embodiment, is equal to or slightly less than the longitudinal dimension 24 of the middle panel 12. The reason for the relationship of the dimensions 24 and 26 will become apparent by reference to various figures wherein it is shown that the bottom panel 14 is folded over the middle panel 12. Then, the upper panel or top panel 10 is folded over the folded middle panel 12 and bottom panel 14. For this reason, the bottom panel 14 is foreshortened relative to the middle panel 12 or at least is no greater in longitudinal dimension 26 than the longitudinal dimension 24 of the middle panel 12. The top panel 10 also includes a longitudinal dimension 28. The longitudinal dimension of the top panel 28 may be equal to or less than, or greater than the longitudinal dimension of the middle panel 12. In the preferred embodiment the longitudinal dimension of the top panel 28 is slightly lesser than that of the middle panel 12. This facilitates the fastening or buckling of the panels 10,12,14 in the closed condition as depicted in FIGS. 3 and 4.

In the preferred embodiment, a retainer strap 30 is positioned over the living hinge 16 connecting the top panel 10 and the middle panel 12. A second retainer strap 32 is provided at the juncture defined by the other living hinge 18.

Optional wing flaps 34 and 36 are attached to the side edges of the top panel 10. The flaps 34 and 36 preferably fold one other the other and may include fastening means or may be made from a material which provides for electrostatic or other attraction so that when the flaps 34 and 36 fold over each other, they will tend to adhere one to the other. The flaps 34 and 36 are thus attached to the side edges of the panel 10 on the opposite sides thereof below a top edge or crown 38 of panel 10.

Optional flaps on wing members 40 and 42 are attached to their respective side edges 44 and 46 of the bottom or lower panel 14. The flaps or wing members 40 and 42 have the same or similar construction as the flaps on wing members 34 and 36 affixed to the top panel 10.

The carrying case includes an inside surface 50 with a ribbon member 52 sewn thereto and in a manner which enables the retention of a series of separated loop members 54, 56 and 58 in FIG. 1. Thus, the ribbon member 52 is sewn as depicted in FIG. 1 with a stitch line 60 to thereby define a stitched section 62 which retains a loop member 54. Ribbon member 52 is then stitched on the opposite side of the loop member 54. In this manner, a number of loop members 54,56,58 are individually attached in serial order, one above the other to the inside surface 50 of the top panel 10. The ribbon member 52 further includes a portion thereof which is sewn so as to hold a support ring 64 at the upper end or crown 38 of the top panel 10.

The outside face 66 of the top panel 10 includes an optional zippered pocket 68 having a zipper 70 for access thereto. The pocket 68 may be utilized, for example, for the storage of collar stays and the like. At the upper end or crown 38 of the panel 10 on the outside face 66 there is attached a buckle 72 cooperative with a buckle member 74 which is attached by an adjustable strap 76 to the outside face of the middle panel 12. The buckle members 72 and 74 are fastened together in order to hold the carrying case in a closed position. The strap 76 may also include a hanging loop 78 as shown in FIG. 4. A second hanging strap 80 may be provided at the opposite end of the middle panel 12. Either strap 76 or 80 may be used to hang the carrying case or to connect it to retention members within the luggage.

Typically, a single tie is placed through a loop 54, for example, as depicted in FIG. 1, and retained by the straps 32 and 30 as well as the wing members or flaps 34, 36, 40 and 42. Each loop member 54, 56, 58 is designed to support and engage a single tie, for example, tie 90 in FIG. 1. Then the bottom or lower panel 14 may be folded over the middle panel 12 depicted in FIG. 2. The upper panel or top panel 10 may then be folded over the panels 12 and 14 as depicted in FIGS. 3 and 4.

Figure 2:
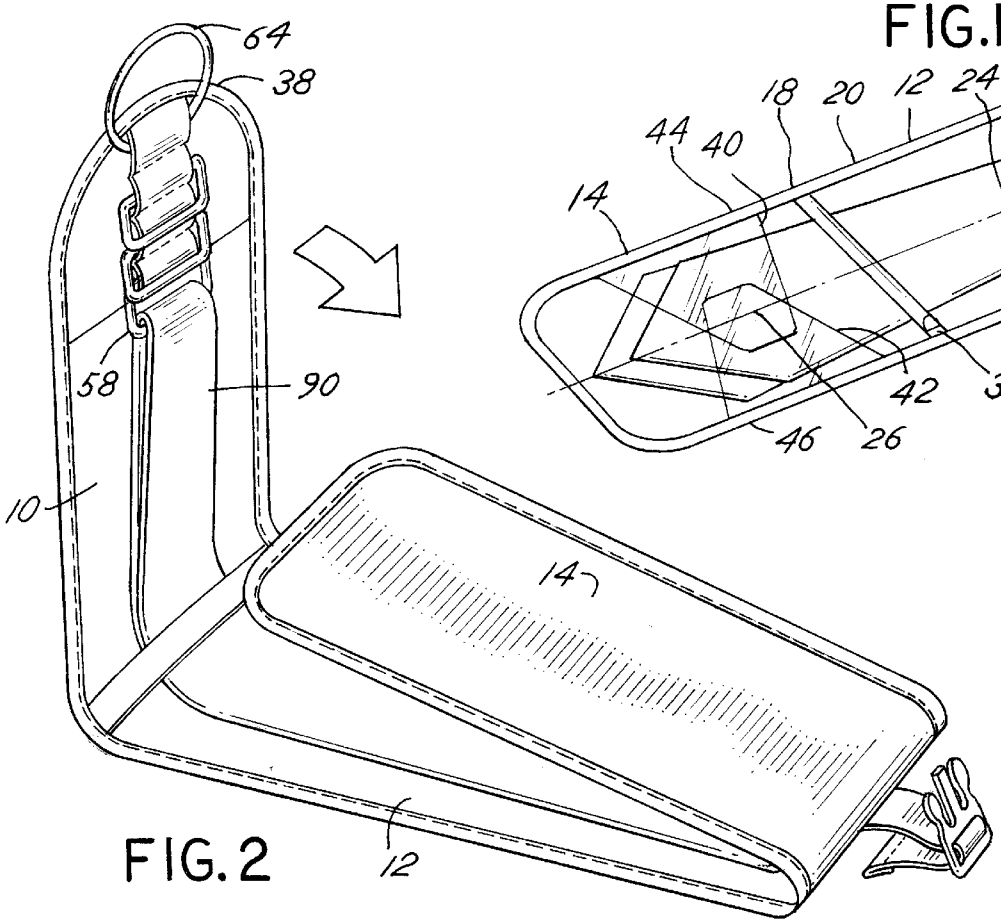
FIG. 2 is an isometric view of the case of FIG. 1 wherein the panels comprising the case are shown in a partially folded condition.

The loop members, for example, loop member 54 has a rectangular shape in the preferred embodiment so that there is provided a straight run, for example, run 80 in FIG. 2 which enables folding the midpoint of the tie over the run 80 as depicted in FIG. 2. It is to be noted that the flaps, or wing members, such as flaps 34, 36 are optional features of the invention, but are preferred. Additionally, the support strap, such as strap 30 is an optional feature. Thus, various alternative features and embodiments of the invention are considered to be within the scope of the invention. The invention is therefore limited only by the following claims and equivalents thereof.

What is claimed is:

1. A carrying case for neckties comprising, in combination:

a first, top, flat, semi-rigid elongate panel having a top end, a bottom hinge end, an inside face and an outside face, and a longitudinal dimension from the top end to the bottom end;

a second, middle, flat semi-rigid elongate panel having a middle top end and a middle bottom end, an inside face, an outside face, and a longitudinal dimension from the top middle end to the bottom middle end;

a third, bottom, flat, semi-rigid elongate panel having a top upper end, a bottom lower end, an inside face an outside face and a longitudinal dimension from the top upper end to the bottom lower end;

a first, fully flexible integral hinge connecting the bottom end of the top panel to the middle top end of the second panel, a second, fully flexible integral hinge connecting the middle bottom end of the second panel and the top upper end of the third panel, whereby the third panel is foldable over the inside surface of the second panel and the first panel is foldable over the outside surface of the third panel, said third panel having a longitudinal dimension less than the longitudinal dimension of the second panel to enable the third panel to be tightly folded against the second panel, said first panel having a longitudinal dimension no greater than the longitudinal dimension of the second panel whereby the first panel is tightly foldable over the outside face of the third panel;

the inside face of the first panel including a plurality of loop members held at the top end by a ribbon member attached to the inside face and fitted through the loop members to enable movement of the loop members;

the longitudinal dimension of each panel being approximately ⅓ of the sum of the longitudinal dimensions of said three panels;

retention strap on the inside face one of the panels extending between the sides of a panel;

a first closure strap and buckle on the outside face of the first panel at the top end;

a second closure strap and buckle at the second flexible hinge on the outside face of one of the panels, said second buckle connectable with the first closure buckle, said first closure strap including a hanging loop member whereby the first and second panels may be attached to retain the panels folded together.

2. The case of claim 1 wherein at least one of the loop members comprises a hook hanger, the remaining loop members comprising tie supports.

3. The case of claim 1 wherein at least one of the panel members includes a pocket on the outside face.

4. The case of claim 1 wherein the loop members for ties comprise a rectangular shaped loop with a straight run aligned along a line from side to side of the top panel.

5. The case of claim 1 further including wing flaps attached to the opposite sides of the first and third panels on the inside face, said flaps foldable over each other and the inside face to retain a tie against the inside face.

* * * * *